US009747818B1

(12) United States Patent
Benedict

(10) Patent No.: US 9,747,818 B1
(45) Date of Patent: Aug. 29, 2017

(54) SIGN HOLDER SYSTEM

(71) Applicant: System 2/90, Inc., Grand Rapids, MI (US)

(72) Inventor: Derek T. Benedict, Grand Rapids, MI (US)

(73) Assignee: System 2/90, Inc., Grand Rapids, MI (US)

( * ) Notice: Subject to any disclaimer, the term of this patent is extended or adjusted under 35 U.S.C. 154(b) by 0 days.

(21) Appl. No.: 15/359,094

(22) Filed: Nov. 22, 2016

(51) Int. Cl.
*G09F 7/18* (2006.01)

(52) U.S. Cl.
CPC ..... *G09F 7/18* (2013.01); *G09F 2007/1847* (2013.01); *G09F 2007/1856* (2013.01)

(58) Field of Classification Search
CPC ..... Y10T 24/45215; Y10T 24/44026; F16B 2/22; F16B 2/20; F16B 5/0685; F16B 5/126; F16B 5/12; F16B 5/0621; F16B 5/0642; F16B 5/0664
See application file for complete search history.

(56) References Cited

U.S. PATENT DOCUMENTS 2,027,086 A 1/1936 Brookey
3,743,147 A * 7/1973 Wilczynski ..... A45F 5/02 224/199
4,184,277 A 1/1980 Larin
5,556,079 A * 9/1996 West ..... E04H 17/143 256/19
5,778,804 A * 7/1998 Read ..... A47B 13/021 248/221.12
D484,778 S * 1/2004 French ..... D8/373
7,302,269 B1 * 11/2007 Crawford ..... G01S 5/0289 455/13.2
2009/0140112 A1 * 6/2009 Carnevali ..... F16B 5/0657 248/223.41

(Continued)

FOREIGN PATENT DOCUMENTS

DE 29806705 U1 6/1998
DE 202005001854 U1 5/2005
DE 102006008460 A1 11/2007

(Continued)

*Primary Examiner* — Cassandra Davis
(74) *Attorney, Agent, or Firm* — Oppenhuizen Law PLC; David L. Oppenhuizen

(57) ABSTRACT

A sign holder system having a back plate and a front plate. The back plate is mountable to a wall surface, and the front plate is removably secured to the back plate. The front plate has a forward-facing surface for displaying indicia, such as a room number or a person's name. The back plate includes at least one recessed opening for receiving a clip attached to the back of the front plate. The recessed opening also includes a recessed pocket. The clip can be slid into the recessed pocket to secure the front plate to the back plate. The recessed pocket can have a ridge which engages with an elevated portion of the clip having similar or matching geometry. The ridge can have a wall that abuts the clip to lock the clip over the ridge. The back plate can additionally include a keyway for permitting a key to pass therethrough. The key has an end that, when inserted through the keyway, deflects the clip away from the ridge, thereby releasing the clip from the ridge and permitting the front plate to be released from the back plate.

8 Claims, 5 Drawing Sheets

(56) References Cited

U.S. PATENT DOCUMENTS

| | | | | |
|---|---|---|---|---|
| 2013/0279976 | A1* | 10/2013 | Jasicki | F16B 5/0084 403/376 |
| 2015/0302781 | A1 | 10/2015 | Jacobson | |

FOREIGN PATENT DOCUMENTS

| | | | |
|---|---|---|---|
| DE | 102011119442 | | 5/2013 |
| DE | 102013018979 | A1 | 5/2015 |
| EP | 1231587 | A2 | 8/2002 |
| EP | 2302611 | B1 | 1/2015 |
| JP | 2006091693 | | 4/2006 |
| JP | 2015194630 | | 11/2015 |
| KR | 200414714 | Y1 | 4/2006 |
| KR | 100961674 | | 6/2010 |
| WO | 9837532 | | 8/1998 |

* cited by examiner

SIGN HOLDER SYSTEM

BACKGROUND OF THE INVENTION

1. Field of the Invention

The present invention pertains to a sign holder having a removable front plate for displaying indicia. More particularly, the present invention pertains to a mechanism in a sign holder for temporarily securing a removable front plate to a back plate.

2. Description of the Prior Art

Sign holders that are secured to a wall surface having a back plate and a removable front plate for bearing an indicia are well-known in the art. For example, U.S. Pat. No. 2,027,086 to Brookey discloses an earlier version of this type of sign holder that includes a key for locking the front plate to the back plate so that the indicia cannot be changed by a passerby.

In addition, U.S. Pat. No. 4,184,277 to Larin discloses a sign holder having a front plate that slidingly engages with the back plate. The sign holder also includes a magnetic locking mechanism to lock the front plate to the back plate.

International patent application publication number WO 1998/037532 to Tyke discloses a sign holder that is similar to the one disclosed by Larin, in which the front plate slidingly engages onto the back plate. In the device disclosed by Tyke, there are end caps which attach to each side of the back plate to keep the front plate from sliding off or being removed.

The present invention seeks to improve upon the prior art by providing a sign holder system in which the front plate slidingly engages with the back plate using a concealed clip mechanism, as well as a concealed locking mechanism and key for selectively locking or unlocking the front plate from the back plate.

SUMMARY OF THE INVENTION

A first embodiment of the present invention provides a sign holder system comprising:

(a) a back plate having a wall-facing surface and a forward-facing surface, the back plate including at least one recessed opening that is open at the forward-facing surface and extends into the back plate, the forward-facing surface extending over a portion of the recessed opening to form a lip which defines a pocket in the recessed opening; and (b) a front plate having a rearward-facing surface and a forward-facing indicia surface, the rearward-facing surface including at least one deflectable clip extending from the rearward-facing surface, the clip having an arm that is secured to the rearward-facing surface on a first end, and a free second end that is resiliently deflectable; and (c) whereby the rearward-facing surface of the front plate is positionable adjacent the forward-facing surface of the back plate and the clip is positionable within the recessed opening, and the front plate is slidable along the back plate such that the free second end of the arm is slidable behind the lip to secure the front plate to the back plate.

Optionally, the lip of the sign holder has an elevated ridge that extends partially into the pocket.

Optionally, the arm of the deflectable clip includes a strip that is elevated away from the rearward-facing surface of the front plate, and the strip extends transversely across the arm from a first side of the arm to a second side of the arm.

Optionally, the free second end of the arm includes a portion that is angled away from the rearward-facing surface of the front plate.

Optionally, the recessed opening can include a first wall and a second wall, in which the first and second walls are spaced apart and oriented parallel to each other. The recessed opening is dimensioned to receive the arm and permit sliding movement of the arm within the recessed opening in a first direction, and the first wall and the second wall are positioned next to the first side and second side of the arm to restrict movement of the arm within the recessed opening in a second direction. Preferably the second direction is along an axis oriented about 90° from the first direction.

According to a second embodiment of the present invention, there is provided a sign holder system comprising:

(a) a back plate having a wall-facing surface and a forward-facing surface, the back plate including at least one recessed opening that is open at the forward-facing surface and extends into the back plate, the forward-facing surface extending over a portion of the recessed opening to form a lip which defines a pocket in the recessed opening, the lip having an elevated ridge that extends partially into the pocket; and (b) a front plate having a rearward-facing surface and a forward-facing indicia surface, the rearward-facing surface including at least one deflectable clip extending from the rearward-facing surface, the clip having an arm that is secured to the rearward-facing surface on a first end, and a free second end that is resiliently deflectable, the arm having a strip that is elevated away from the rearward-facing surface of the front plate, the strip extending transversely across the arm from a first side of the arm to a second side of the arm; and (c) whereby the rearward-facing surface of the front plate is positionable adjacent the forward-facing surface of the back plate and the clip is positionable within the recessed opening, and the front plate is slidable along the back plate such that the free second end of the arm is slidable behind the lip and the elevated strip on the arm is seatable onto the ridge of the lip to secure the front plate to the back plate.

Optionally, the ridge has an upper surface and a first ridge wall, and the arm has an underside surface in which the underside surface of the strip is seatable flush atop the upper surface of the ridge wall.

Optionally, the back plate can include a keyway extending through a portion of the back plate and into the recessed opening.

Optionally, the sign holder system can also include a key in which the key can be insertable into the keyway such that the end of the key forces the deflectable arm away from the ridge, thereby releasing the deflectable clip from the lip and permitting the front plate to be slid along the back plate to release the front plate from the back plate.

Optionally, the ridge can have an upper surface and a first ridge wall, and the arm has an underside surface in which the underside surface of the strip is seatable flush atop the upper surface of the ridge wall. The upper surface and the first ridge wall are preferably oriented about 90° from each other to form a substantially right angle, and the underside surface of the arm has an angled section that is angled about 90° from the underside surface of the strip. Accordingly, the angled section abuts the first ridge wall and locks the deflectable clip onto the lip.

For a more complete understanding of the present invention, reference is made to the following detailed description and accompanying drawings. In the drawings, like reference characters refer to like parts throughout the views in which:

DETAILED DESCRIPTION OF THE PREFERRED EMBODIMENT

As used hereinbelow, the term "forward" is used to generally indicate a direction toward a user who is viewing the indicia on the front plate of the sign holder system, which is typically vertically-oriented. Likewise, the term "rearward" is used to generally indicate a direction away from the user and toward a wall or other surface upon which the sign holder system is mounted.

Figure 1:
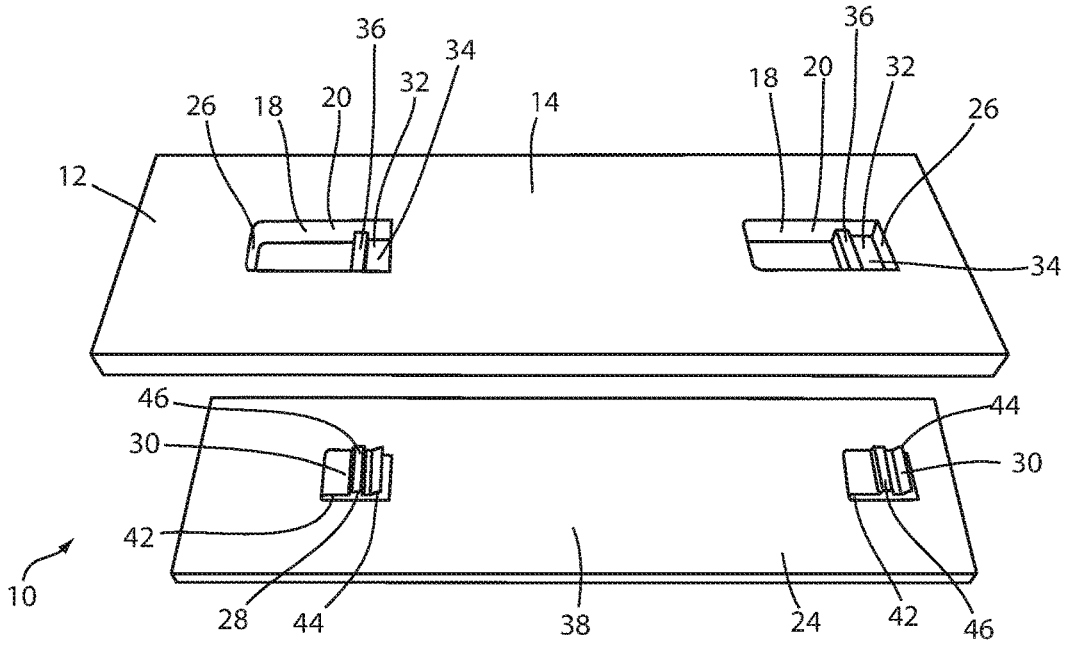
FIG. 1 is an exploded perspective view of a first embodiment of the present invention hereof showing the sign holder system from a generally rearward direction with the front plate and the back plate being disconnected from each other.
Figure 2:
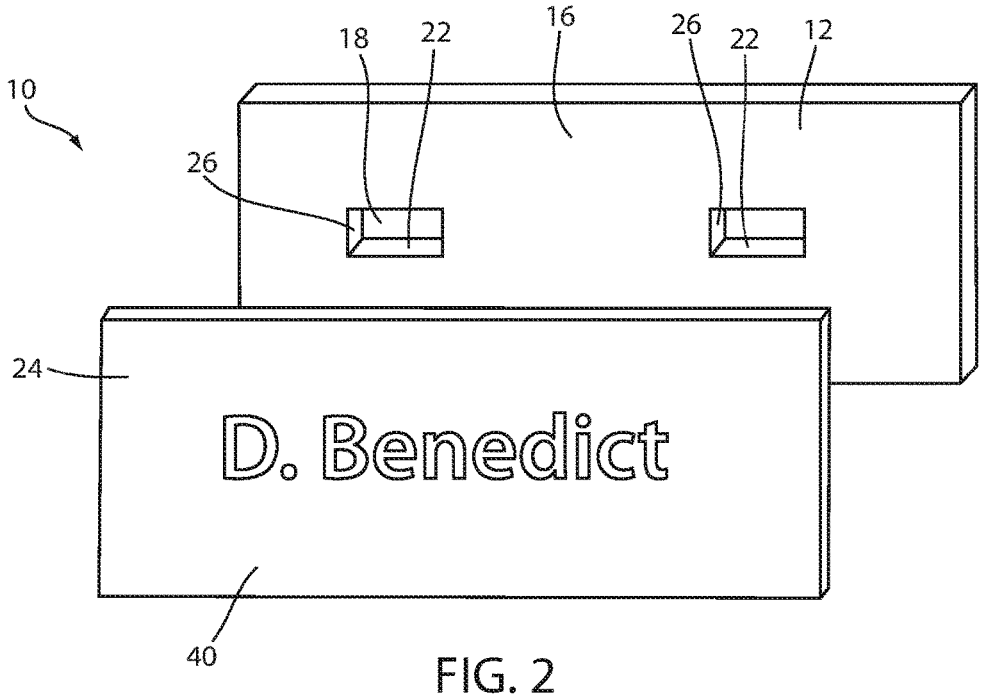
FIG. 2 is an exploded perspective view of the first embodiment of the present invention hereof showing the sign holder system from a generally forward direction with the front plate and the back plate being disconnected from each other.
Figure 3:
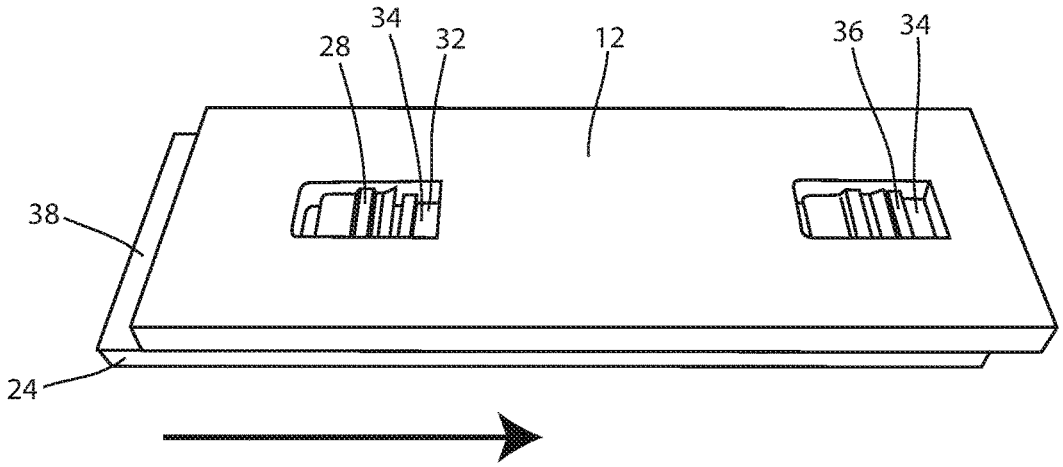
FIG. 3 is a view of the sign holder system from a rearward direction showing the clip positioned within the recessed opening, but not engaged over the lip, the arrow in the drawing indicating the direction that the front plate needs to be moved to secure the front plate to the back plate.
Figure 4:
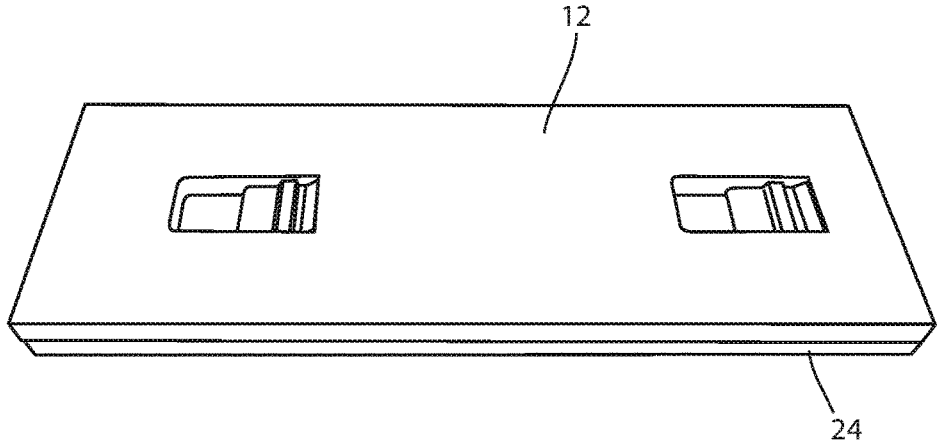
FIG. 4 is a view of the sign holder system from a rearward direction showing the clip positioned within the recessed opening and engaged over the lip, thereby securing the front plate to the back plate.

In accordance with a first embodiment of the present invention and as shown generally in FIGS. 1 and 2, there is provided a sign holder system 10 comprising a back plate 12 having a planar rearward wall-facing surface 14 and a planar forward-facing surface 16. The back plate 12 is preferably generally rectangular in shape and is preferably relatively thin. The back plate 12 includes at least one recessed opening 18 that is open at the forward-facing surface 16 and extends into the back plate 12. The recessed opening 18 can extend through the back plate 12, although it does not necessarily need to do so, and if desired, it can extend only partially into the back plate 12.

The recessed opening 18 can include a first wall 20 and a second wall 22. The first wall 20 can be positioned as a top wall, although it may also be positioned as a side wall. Likewise, the second wall 22 can be positioned as a bottom wall, although it may also be positioned as a side wall. Therefore, as described in greater detail below, the first wall 20 and the second wall 22 restrict the direction of movement of the front plate 24 with respect to the back plate 12. Thus, the front plate 24 can slidingly engage with the back plate 12 in a horizontal side-to-side direction, in a vertical up-and-down direction, or in any other suitable direction. The first wall 20 and the second wall 22 are preferably spaced apart and oriented parallel to each other.

The recessed opening 18 can also include a pair of opposed end walls 26 positioned opposite each other and extending between the first wall 20 and the second wall 22. The first wall 20, the second wall 22, and the end walls 26 define the recessed opening 18 which is dimensioned to receive the arm 28 of the deflectable clip 30. The recessed opening 18 is sized to permit sliding movement of the clip 30 within the recessed opening 18 in a first direction, in which the first wall 20 and the second wall 22 are positioned next to the first side and the second side of the clip arm 28 to restrict movement of the arm 28 within the recessed opening 18 in a second direction. Preferably, the clip 30 can only slide within the recessed opening 18 back and forth along a single axis.

The recessed opening 18 also includes a pocket 32 which is formed within the back plate 12. The pocket 32 is not exposed or open through the forward-facing surface 16. Rather, the pocket 32 is preferably defined as a recessed cutout along one of the end walls 26 and is concealed beneath, or behind the forward-facing surface 16. The pocket 32 may or may not be open or exposed to the rearward-facing surface 38 of the back plate 12. The forward-facing surface 16 extending over the pocket 32 forms a lip 34, which may optionally include an elevated ridge 36 extending along the lip 34.

The back plate 12 is preferably formed from a rigid polymer material, such as acrylic. Alternatively, the back plate 12 could be formed from a metal material, as well as any other suitable type of material. The back plate 12 can be manufactured using any suitable type of process that is well-known in the art. For example, the back plate 12 and its features discussed above can be machined from a solid piece of material, or the back plate 12 can be injection molded, and so forth.

The sign holder system 10 also includes a front plate 24 having a rearward-facing surface 38 and a forward-facing indicia surface 40. The forward-facing indicia surface 40 can display any suitable type of indicia, such as an individual's name, a room name, a room number, etc. The rearward-facing surface 38 can include at least one deflectable clip 30 that extends rearwardly from the rearward-facing surface 38. The clip 30 includes an arm 28 having a first end 42 and a second end 44. The first end 42 is secured to the rearward-facing surface 38, and the second end 44 is freely resiliently deflectable with respect to the front plate 24. The clip 30 can be formed from a separate piece that is secured, or adhered, to the rearward-facing surface 38 of the front plate 24. Alternatively, the clip 30 can be formed integrally with the front plate 24.

In the embodiment shown in the drawings, the arm 28 is elevated from the rearward-facing surface 38, but is generally oriented along a plane parallel to the rearward-facing surface 38. The arm 28 is preferably elongated, wide, and thin to permit deflection with respect to the rearward-facing surface 38 in a single direction along a single axis. More preferably, the arm 28 deflects and pivots about the first end 42 thereof with respect to the rearward-facing surface 38. The clip 30 can be formed from any resiliently flexible material, such as a plastic polymer, a metal material, or the like.

Figure 5:
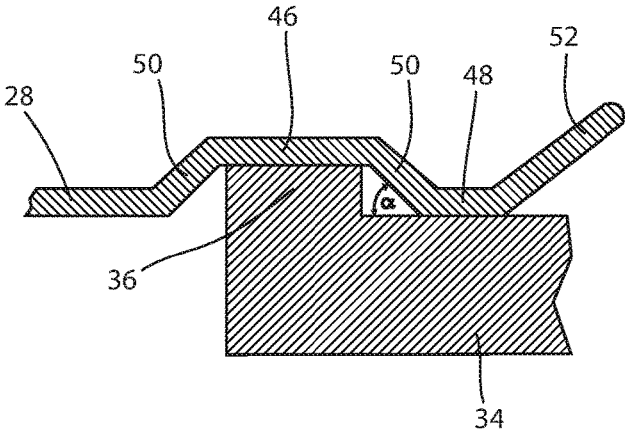
FIG. 5 is an enlarged sectional view of FIG. 4 showing the elevated deflectable arm positioned atop the ridge while the front plate is secured to the back plate.

As shown throughout the drawings, the arm 28 of the deflectable clip 30 can also include a strip 46 that is elevated, or bent, in a direction away from the rearward-facing surface 38 of the front plate 24. The strip 46 extends across the arm 28 in a transverse direction from a first side of the arm 28 to a second side of the arm 28. The arm 28 also includes a tongue section 48 positioned proximate to the elevated strip 46, which is shown best in FIG. 5. There is also provided an angled section 50 to transition between the strip 46 and the tongue section 48. Preferably the angled section 50 is angled in the range of 30° to 60° from the plane upon which the tongue 48 is positioned, which is indicated as a in FIG. 5. Importantly, the angled section 50 allows the arm 28 to deflect up and over the ridge 36 when the user wishes to slide the front plate 24 in order to release the front plate 24 from the back plate 12.

In addition, the free second end 44 of the arm 28 includes an angled end 52 that is angled away from the rearward-facing surface 38 of the front plate 24.

In use, the front plate 24 is positioned in front of the back plate 12 such that the rearward-facing surface 38 of the front plate 24 is placed adjacent the forward-facing surface 16 of the back plate 12. The clip 30 is contemporaneously positioned within the recessed opening 18. Next, the front plate 24 is slid along the back plate 12 so that the free second end 44 of the arm 28 is slid behind the lip 34. As the front plate 24 is slid, the angled end 52 abuts against the ridge 36, thereby deflecting the arm 28 upward over the ridge 36. As the front plate 24 continues to be slid, the upward angled section 50 and elevated strip 46 allow the deflectable arm 28 to deflect back down over the ridge 36 when the elevated strip 46 is seated atop the ridge 36. In this configuration, the elevated strip 46 on the arm 28 is thus seated atop and over the ridge 36 on the lip 34 to secure the front plate 24 to the back plate 12.

In order to release the front plate 24 from the back plate 12, the front plate 24 is simply slid so that the clip 30 is moved out of the pocket 32 and out from behind the lip 34, thereby allowing the front plate 24 to be removed from the back plate 12. This is made possible by the angled section 50 which gradually flexes the arm 28 away from the ridge 36 to permit the tongue section 48 to pass over the ridge 36, thereby releasing the clip 30 from the ridge 36 and permitting the front plate 24 to be removed from the back plate 12. The deflectable clip 30 is resiliently flexible, which allows the arm 28 of the clip 30 to be deflected up and over the ridge 36 on the lip 34 to secure the clip 30 within the recessed pocket 32.

Figure 6:
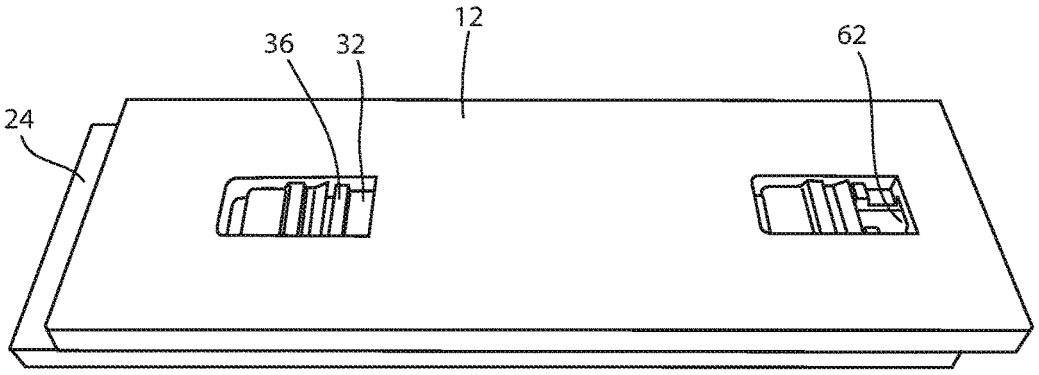
FIG. 6 is a view of a second embodiment of the sign holder system from a rearward direction showing the clip positioned within the recessed opening, but not engaged over the lip.

There is also provided a second embodiment of the present invention which includes a locking mechanism for selectively locking and unlocking the front plate 24 from the back plate 12. According to this second embodiment, and as shown best in FIGS. 6 and 8, the ridge 36 has an upper surface 54 and a ridge retainer wall 56. In addition, the arm 28 has an underside surface 58 in which the underside surface 58 of the strip 46 is seatable flush atop the upper surface 54 of the ridge 36.

Figure 10:
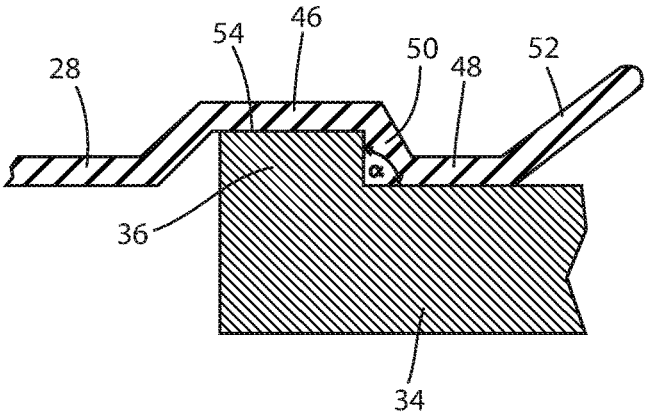
FIG. 10 is sectional view of the second embodiment hereof showing the deflectable arm seated atop the ridge.

The ridge retainer wall 56 and the angled section 50 of the arm 28 are preferably angled so that they are flush with one another. Even more preferably, the angle α between the ridge retainer wall 56 and the angled section 50 is in the range of 75° to 105° from the plane upon which the tongue section 48 is positioned. Most preferably, and as shown in FIG. 10, angle α between the ridge retainer wall 56 and the angled section 50 is about 90°. Furthermore, the upper surface 54 and the ridge retainer wall 56 are oriented about 90° from each other to form a substantially right angle, and the underside surface 58 of the arm 28 has an angled section 50 that is angled about 90° from the underside surface 58 of the strip 46. Accordingly, the angled section 50 abuts the ridge retainer wall 56 and locks the deflectable clip 30 onto the lip 34.

Figure 7:
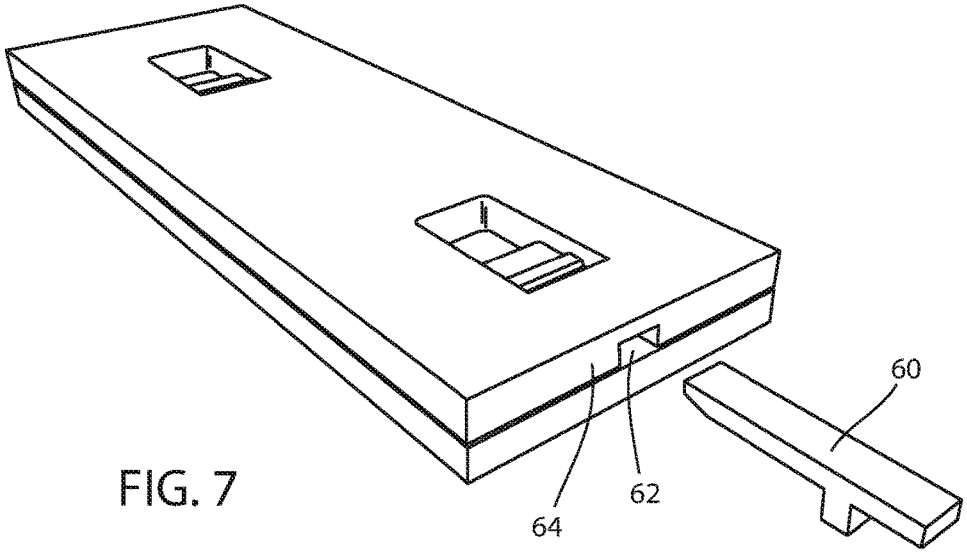
FIG. 7 is a view of a second embodiment of the sign holder system from a rearward direction showing the clip positioned within the recessed opening and secured over the lip, and also showing a key aligned with the keyway on the side of the back plate.
Figure 8:
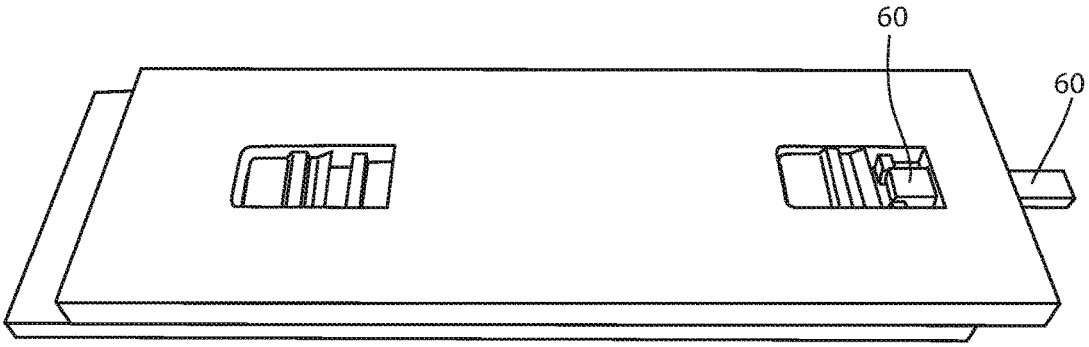
FIG. 8 is a view of a second embodiment of the sign holder system from a rearward direction showing the clip positioned within the recessed opening, but not engaged over the lip, and also showing a key inserted into the keyway to demonstrate the position of the key when inserted into the keyway.

This second embodiment of the present invention also includes a key 60 which passes through a keyway 62 in order to deflect the arm 28 over the ridge 36 in order to unlock the front plate 24 from the back plate 12. As shown in FIGS. 7 and 8, the keyway 62 extends from an outer edge 64 of the back plate 12 and through a portion of the back plate 12 and into the recessed opening 18. The keyway 62 also extends through a portion of the lip 34 and a portion of the ridge 36. Preferably, the keyway 62 has a rectangular cross-section, although it could have any suitable size or geometric configuration, as long as the keyway 62 is dimensioned to receive the key 60.

Figure 9:
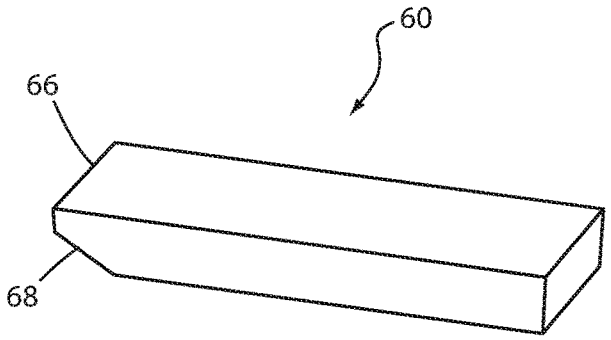
FIG. 9 is an enlarged view showing an exemplary embodiment of a key for use in releasing the locking mechanism to detach the front plate from the back plate.

The key 60 has an elongated body which is insertable into the keyway 62 from the outer edge of the back plate 12. As mentioned above, the key 60 and the keyway 62 preferably have substantially matching geometric cross-sectional configurations to permit the key 60 to pass through the keyway 62. Even more preferably, the keyway 62 and the key 60 have rectangular cross-sections. The key 60 preferably has an angled tip 66 to assist in deflecting the arm 28 up and over the ridge 36 when the key 60 is inserted into the keyway 62. As shown in FIG. 9, the angled tip 66 provides for a narrowed edge 68 on a first side of the key 60. Optionally, the key 60 can also having an outward bend (not shown) on a second side of the key 60 opposite the narrowed edge 68.

Figure 11:
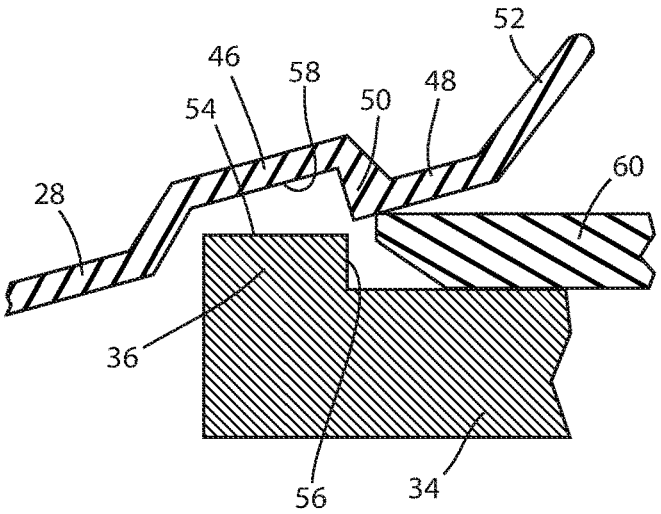
FIG. 11 is a sectional view of the second embodiment hereof showing the showing the key inserted through the keyway and deflecting the arm away from the ridge so as to release the arm from the ridge.

In use, and as shown best in FIGS. 8, 10, and 11, the key 60 is inserted into the keyway 62 with the angled tip 66 oriented in the forward direction. The key 60 passes through the keyway 62 until the outward bend 70 of the key 60 comes into contact with the angled end 52 of the arm 28. The outward bend 70 then deflects the angled end 52 of the arm 28 up from the ridge 36 to release the angled section 50 of the arm 28 from the ridge retainer wall 56 of the ridge 36. The front plate 24 can then be freely released from the back plate 12 once the deflectable arm 28 has been released from the ridge 36.

Importantly, it is noted that the key 60 can have any suitable type of end, including a blunt end, a rounded end, a bent end, and so forth. For example, the key 60 described above having an angled tip 66 will function correctly to deflect the clip arm 28 away from the ridge 36 regardless of the orientation of the key 60 as inserted into the keyway 62. In other words, the key 60 will function correctly if either the angled tip 66 or the outward bend 70 abut against the arm 28. The primary difference in the orientation of the key 60 thus becomes how far the key 60 needs to be inserted into the keyway 62 to sufficiently deflect the arm 28 of the clip 30. However, as mentioned above, the key 60 will work in either orientation.

According to the invention described above, there is provided a sign holder system in which the front plate slidingly engages with the back plate using a concealed clip mechanism, as well as a concealed locking mechanism and key for selectively locking or unlocking the front plate from the back plate.

What is claimed is:

1. A sign holder system comprising:

(a) a back plate having a wall-facing surface and a forward-facing surface, the back plate including at least one recessed opening that is open at the forward-facing surface and extends into the back plate, the forward-facing surface extending over a portion of the recessed opening to form a lip which defines a pocket in the recessed opening, the lip having an elevated ridge that extends partially into the pocket, the ridge having an upper surface and a first ridge wall; and (b) a front plate having a rearward-facing surface and a forward-facing indicia surface, the rearward-facing surface including at least one deflectable clip extending from the rearward-facing surface, the clip having an arm that is secured to the rearward-facing surface on a first end, and a free second end that is resiliently deflectable, the arm having a strip that is elevated away from the rearward-facing surface of the front plate, the strip extending transversely across the arm from a first side of the arm to a second side of the arm, and the arm has an underside surface in which the underside surface of the strip is seated flush atop the upper surface of the ridge wall; and (c) whereby the rearward-facing surface of the front plate is positionable adjacent the forward-facing surface of the back plate and the clip is positionable within the recessed opening, and the front plate is slidable along the back plate such that the free second end of the arm is slidable behind the lip and the elevated strip on the arm is seatable onto the ridge of the lip to secure the front plate to the back plate.

2. The sign holder system of claim 1 wherein the back plate includes a keyway extending through a portion of the back plate and into the recessed opening.

3. The sign holder system of claim 2 including a key, whereby the key is insertable into the keyway and an end of the key forces the deflectable arm away from the ridge, thereby releasing the deflectable clip from the lip and permitting the front plate to be slid along the back plate and releasing the front plate from the back plate.

4. A sign holder system comprising:

(a) a back plate having a wall-facing surface and a forward-facing surface, the back plate including at least one recessed opening that is open at the forward-facing surface and extends into the back plate, the forward-facing surface extending over a portion of the recessed opening to form a lip which defines a pocket in the recessed opening, the lip having an elevated ridge that extends partially into the pocket; and (b) a front plate having a rearward-facing surface and a forward-facing indicia surface, the rearward-facing surface including at least one deflectable clip extending from the rearward-facing surface, the clip having an arm that is secured to the rearward-facing surface on a first end, and a free second end that is resiliently deflectable, the arm having a strip that is elevated away from the rearward-facing surface of the front plate, the strip extending transversely across the arm from a first side of the arm to a second side of the arm; and (c) whereby the rearward-facing surface of the front plate is positionable adjacent the forward-facing surface of the back plate and the clip is positionable within the recessed opening, and the front plate is slidable along the back plate such that the free second end of the arm is slidable behind the lip and the elevated strip on the arm is seatable onto the ridge of the lip to secure the front plate to the back plate;

wherein the ridge has an upper surface and a first ridge wall, and the arm has an underside surface in which the underside surface of the strip is seated flush atop the upper surface of the ridge wall, the upper surface and the first ridge wall being oriented about 90° from each other to form a substantially right angle, and the underside surface of the arm having an angled section that is angled about 90° from the underside surface of the strip, whereby the angled section abuts the first ridge wall and locks the deflectable clip onto the lip.

5. The sign holder system of claim 4 wherein the back plate includes a keyway extending through a portion of the back plate and into the recessed opening.

6. The sign holder system of claim 5 including a key, whereby the key is insertable into the keyway and an end of the key forces the deflectable arm away from the ridge, thereby releasing the deflectable clip from the lip and permitting the front plate to be slid along the back plate and releasing the front plate from the back plate.

7. A sign holder system comprising:

(a) a back plate having a wall-facing surface and a forward-facing surface, the back plate including at least one recessed opening that is open at the forward-facing surface and extends into the back plate, the forward-facing surface extending over a portion of the recessed opening to form a lip which defines a pocket in the recessed opening, the lip having an elevated ridge that extends partially into the pocket, the back plate including a keyway extending through a portion of the back plate and into the recessed opening; and (b) a front plate having a rearward-facing surface and a forward-facing indicia surface, the rearward-facing surface including at least one deflectable clip extending from the rearward-facing surface, the clip having an arm that is secured to the rearward-facing surface on a first end, and a free second end that is resiliently deflectable, the arm having a strip that is elevated away from the rearward-facing surface of the front plate, the strip extending transversely across the arm from a first side of the arm to a second side of the arm; and (c) whereby the rearward-facing surface of the front plate is positionable adjacent the forward-facing surface of the back plate and the clip is positionable within the recessed opening, and the front plate is slidable along the back plate such that the free second end of the arm is slidable behind the lip and the elevated strip on the arm is seatable onto the ridge of the lip to secure the front plate to the back plate.

8. The sign holder system of claim 7 including a key, whereby the key is insertable into the keyway and an end of the key forces the deflectable arm away from the ridge, thereby releasing the deflectable clip from the lip and permitting the front plate to be slid along the back plate and releasing the front plate from the back plate.

* * * * *